US008613210B2

(12) United States Patent
Wagner et al.

(10) Patent No.: US 8,613,210 B2
(45) Date of Patent: Dec. 24, 2013

(54) METHOD FOR MONITORING THE WEAR OF MANUAL PLIERS AND APPARATUS THEREFOR

(75) Inventors: Thomas Wagner, Bermbach (DE); Peter Lutze, Bermbach (DE)

(73) Assignee: Rennsteig Werkzeuge GmbH (DE)

( * ) Notice: Subject to any disclaimer, the term of this patent is extended or adjusted under 35 U.S.C. 154(b) by 0 days.

(21) Appl. No.: 13/321,837

(22) PCT Filed: May 17, 2010

(86) PCT No.: PCT/EP2010/056692

§ 371 (c)(1),
(2), (4) Date: Nov. 22, 2011

(87) PCT Pub. No.: WO2010/136346

PCT Pub. Date: Dec. 2, 2010

(65) Prior Publication Data

US 2012/0067097 A1 Mar. 22, 2012

(30) Foreign Application Priority Data

May 26, 2009 (DE) ..... 10 2009 026 470

(51) Int. Cl.
*B21D 55/00* (2006.01)

(52) U.S. Cl.
USPC ..... 72/20.1; 72/31.01; 72/409.01

(58) Field of Classification Search
USPC ..... 72/20.1, 20.2, 30.1, 31.01, 409.01, 72/409.06, 409.07, 409.08, 409.19; 81/300, 313; 73/818
See application file for complete search history.

(56) References Cited

U.S. PATENT DOCUMENTS

| | | | | | |
|---|---|---|---|---|---|
| 3,345,856 | A | * | 10/1967 | Myers et al. | 72/409.01 |
| 3,554,000 | A | * | 1/1971 | Schwab | 72/453.15 |
| 5,337,589 | A | * | 8/1994 | Gloe et al. | 72/9.5 |
| 5,490,406 | A | * | 2/1996 | College | 72/30.1 |
| 6,035,775 | A | * | 3/2000 | Nghiem | 100/43 |
| 6,164,106 | A | * | 12/2000 | Nghiem et al. | 72/20.1 |
| 8,079,242 | B2 | * | 12/2011 | Pacaud et al. | 72/21.4 |

FOREIGN PATENT DOCUMENTS

| | | | | |
|---|---|---|---|---|
| DE | 29806179 U1 | | 10/1998 | |
| DE | 29815312 U1 | | 11/1998 | |
| DE | 10060165 | * | 6/2002 | B25B 7/12 |

(Continued)

OTHER PUBLICATIONS

Translation of International Preliminary Report on Patentability dated Dec. 16, 2011, 6 pages.

*Primary Examiner* — Edward Tolan
(74) *Attorney, Agent, or Firm* — Mayer & Williams PC

(57) ABSTRACT

A method and apparatus for monitoring the wear of manual pliers. The principles focus on manual pliers, in which press elements can be pressed onto a workpiece and the degree of pressing that can be achieved by actuating the manual pliers can be adjusted with a presetting device. A reference position of the presetting device is measured prior to a first use of the manual pliers, this measurement involving actuating the manual pliers. By an adjustment of the presetting device, the press elements are brought into a position with a reference degree of pressing. Next, after use, the wear position of the presetting device is measured in the same manner, to bring the press elements into a position with the degree of pressing. A message is output when the degree of the wear position deviates from the degree of the reference position by more than the degree of wear permissible.

17 Claims, 2 Drawing Sheets

(56) References Cited

FOREIGN PATENT DOCUMENTS

| | | | | | |
|---|---|---|---|---|---|
| DE | 10060165 | A1 | | 6/2002 | |
| DE | 102004009489 | | * | 9/2005 | ..... B25B 7/12 |
| DE | 102004009489 | A1 | | 9/2005 | |
| FR | 2916091 | A1 | | 11/2008 | |

* cited by examiner

METHOD FOR MONITORING THE WEAR OF MANUAL PLIERS AND APPARATUS THEREFOR

FIELD OF THE INVENTION

The present invention relates to a method for monitoring the wear of manual pliers and an apparatus suitable for it. The invention furthermore relates to manual pliers, the wear of which is monitored. The invention focuses on a crimping tool, in which the press elements can be pressed onto a workpiece, and the degree of pressing that can be attained by actuating the manual pliers with a presetting device. The invention is particularly suitable for the use of crimping pliers, on which the degree of crimping is adjustable.

BACKGROUND OF THE INVENTION

DE 10 2004 009 489 A1 describes an adjustment display for crimping pliers, in which the crimping punches acting upon the crimp contacts are brought into the crimp position by a pivoted piston that is guided in a cam element. The selected pre-adjustment of the crimping pliers is indicated by an electronic display. When the crimping punches or the cam element are worn, then the value of the pre-adjustment display is incorrect, however.

DE 296 02 238 U1 illustrates a test device for testing of pressure tools or their components supporting the press jaws. The pressure tool or a part of same must be inserted into the test device in a specific position. During the testing procedure, a blank pressing operation is performed, where after the application of the pressure the gap width between two opposite faces of adjacent press jaws is measured. The gap width is indicated to the operator, who can then decide whether the press tool can continue to be used or not. This solution is only suitable for press tools in which the press jaws basically strike against each other during actuation of the press tool, and/or where only one degree of pressing can be realized with them.

DE 200 12 887 U1 illustrates a device for the wear test on crimping pliers. This device includes a test element which includes an indicator and is to be arranged between the faces of the press jaws of the crimping pliers when compressing an object. The indicator is compressed below a predetermined, comparatively small gap width. Also this solution is only suitable for crimping pliers in which the press jaws basically strike against each other during actuation of the crimping pliers, and/or where only one degree of pressing can be realized with them.

SUMMARY OF THE INVENTION

An object of the present invention is to provide a method for monitoring the wear of manual pliers, which is particularly suited for manual pliers in which the press elements can be pressed onto a workpiece and the degree of pressing to be attained by actuating the manual pliers is adjustable with a presetting device in a specified range. The object moreover is to provide a corresponding device for monitoring the wear of such a manual pliers. In particular, such manual pliers should allow monitoring the wear and to compensate for it by a subsequent calibration within pre-specified limits.

The said purpose is solved by a method pursuant to the enclosed Claim 1, by a device pursuant to the coordinate Claim 12 and by manual pliers pursuant to the co-ordinate Claims 15 and 16.

The method as taught by the invention serves to monitor the wear of manual pliers with which press elements can be pressed onto a workpiece. The degree of pressing to be achieved, i.e. the distance between the press elements to be obtained during a complete actuation of the manual pliers, can be adjusted with a presetting device. The presetting device can serve the purpose, for example, for adapting the manual pliers to differently sized workpieces to be compressed. In any case, the presetting device is suitable for compensating the wear of the manual pliers. During the normal use of the manual pliers, the degree of pressing to be achieved must be adjusted with the presetting device before the manual pliers is actuated, and/or the position of the presetting device must be checked. Subsequently, the manual pliers is to be actuated, as a result of which the press elements are moved towards each other up to the adjusted degree of pressing.

The method as taught by the invention initially comprises the step that a reference position of the presetting device is detected and/or measured. This detection/measurement occurs prior to the first use of the manual pliers following its manufacture, or after it is serviced. In this context it is therefore assumed that the manual pliers is not worn. To measure the reference position, the manual pliers must be actuated, as a result of which the press elements are brought into a position where they have the degree of pressing that was adjusted at this time. By the adjustment of the presetting device, the press elements are then to be brought into a position in which they have a reference degree of pressing. In this context it is to be ensured that the press elements actually accomplish the reference degree of pressing. The reference degree of pressing must consequently be determined directly on the press elements, for example in that a calibration standard, e.g. a mandrel gage is placed between the press elements.

The reference degree of pressing can alternatively be controlled using a measuring instrument, for example. As soon as the press elements are brought into the position which has the reference degree of pressing, the presetting device is in the reference position which is to be measured. The result of the first step of the method as taught by the invention provides a measure for the reference position of the presetting device.

In a second step of the method as taught by the invention, a wear position of the presetting device is measured. This step is done after the manual pliers has been used once or several times, as a result of which wear could possibly have occurred on the manual pliers. Also the measurement of the wear position is performed in the actuated state of the manual pliers.

The presetting device must be adjusted in the same manner as during the measuring of the reference position, in order to place the press elements into a position which shows the reference degree of pressing. If wear has already occurred on the manual pliers, such as wear of the press elements, then the press elements will have another position in which they can accomplish the reference degree of pressing. Consequently, the presetting device will also have a position which deviates from the reference position. In the result of the second step of the method as taught by the invention, a measure exists for the wear position of the presetting device. The invention teaches that a message is output when the degree of the wear position deviates from the degree of the reference position by more than a permissible degree of wear. This message ensures that the user of the manual pliers no longer uses the manual pliers as soon as the manual pliers, in particular its press elements, are worn in excess of the degree permissible. By this message it can be ensured that the user of the manual pliers will no longer use the manual pliers, as soon as the manual pliers, in particular its press elements, have been worn by more than a permissible size.

Although the user would be able to continue to achieve the desired degree of pressing, without the message the user would not know, however, whether the result of the compression would still satisfy the requirements in spite of the wear of the press elements. As a result, it can be prevented, for example, that a compression is performed with the manual pliers, which, although it may accomplish the required degree of pressing, would produce insufficient forming of the workpiece, however, because of worn press elements. The message could also be provided optically, acoustically, or even in that it prevents the use of the manual pliers, for example.

With the method as taught by the invention it is for the first time possible to monitor the wear on manual pliers continuously and as a result ensure that the quality of the compression result is at a consistently high level. The second step of the method as taught by the invention, namely the measurement of the wear position, must be repeated for this purpose after a certain number of uses of the manual pliers. As soon as the pliers and/or is press element have been worn by more than the permissible degree of wear, a message is output. A request for a new wear control to be performed can be generated optionally when a specified number of compressions have been performed.

The measurement of the reference position and the measurement of the wear position can be performed on an absolute or relative basis. Because of the low complexity, the relative measurement is preferred for many applications. The measurement of the reference position and the measurement of the wear position is then performed respectively in that a change in the position of the presetting device is measured, while the presetting device is brought into the reference position and/or the wear position, based upon a mechanically defined reference position.

The mechanically defined reference position of the presetting device has the advantage that it is independent from an electronically stored measured value of the position of the presetting device, for example. The mechanically defined reference position is thus even retained, if the power supply of a device for the electronic measurement of the position of the presetting device is interrupted, for example.

The mechanically defined reference position is preferably formed by a mechanical stop of the presetting device, in which the press elements have the minimum adjustable degree of pressing. This therefore involves a lower stop of the presetting device, based upon which the reference position and the wear position of the presetting device are determined. But the mechanically defined reference position can also be formed by a stop position, by a marking, or similar, however.

In a preferred embodiment of the method as taught by the invention, the position of the presetting device will be measured continuously during the normal use of the manual pliers. The measured size of the presetting device position is converted continuously to the respectively adjusted degree of pressing. For this conversion, it must be at least known what dependence the change of the degree of pressing has from the change of the presetting device position. This dependence can be measured based upon the sizing of the manual pliers, for example, or by a measurement series. The calculated degree of pressing will be indicated in this embodiment as taught by the invention, so that the user of the manual pliers can read-off the respectively adjusted degree of pressing.

This embodiment also has the advantage among other things that the manual pliers can be adapted easily to other degrees of pressing to be achieved.

As in any optional position of the presetting device, the adjusted degree of pressing will also be calculated in the reference position of the presetting device from its measured position. This particular degree of pressing is preferably stored during the measurement of the reference position, so that it can be indicated at any time later.

In a further preferred embodiment of the method as taught by the invention, the deviation of the wear position from the reference position is converted to wear based on the degree of pressing and is indicated. This conversion in turn is based upon the dependence of the change of the degree of pressing from the change of the position of the presetting device. In this embodiment of the method as taught by the invention, the user can be shown on request how high the amount of wear is on the manual pliers. The wear can be indicated in μm, for example.

The conversion of the degree of the position of the presetting device in the respective degree of pressing is performed preferably depending upon the degree of the wear position last measured. In this embodiment of the method as taught by the invention, the second step, namely the measuring of the wear position, at the same time represents a calibration of the indication of the degree of pressing. In this context, the reference degree of pressing serves as the starting point for the conversion. Respective to the measured change in the position of the presetting device, conclusions are made with respect to a change in the degree of pressing compared to the reference degree of pressing.

After each measurement of the wear position of the presetting device, i.e. after each calibration procedure, preferably a calibration counter is incremented, as a result of which it is known how often the manual pliers was calibrated after its manufacture, or how often the calibration counter was calibrated following servicing. Preferably a value of the calibration counter is indicated, so that it can be read-off particularly in the event of servicing. The value of the calibration counter is preferably stored in a non-volatile memory.

The apparatus as taught by the invention serves for monitoring the wear of manual pliers. With manual pliers, the press elements can be pressed onto a workpiece. The degree of pressing to be obtained by actuating the manual pliers is adjustable with a presetting device. The device is configured for performing the method as taught by the invention. The calibration of the indication of the degree of pressing already mentioned earlier serves during any wear that has occurred for the correction of the value of wear in the display, so that in spite of the wear of the press elements, the actual degree of pressing to be obtained is indicated, i.e. that it can be adjusted correctly. The invention teaches that this wear correction must be kept within specified limits, in order to maintain the high quality of the pressing procedure.

The apparatus as taught by the invention preferably includes an absolute and incremental position sensor for measuring the position of the presetting device. If an absolute position system is used, then no reference position of the presetting device is necessary.

With the manual pliers as taught by the invention, press elements can be pressed onto a workpiece. The degree of pressing to be achieved by actuation of the manual pliers is adjustable with a presetting device.

The manual pliers includes an apparatus for monitoring the wear of the manual pliers as taught by the invention. With the manual pliers as taught by the invention this can include manual pliers, for example, with which flat press jaws in pairs opposite one another are pressed onto a workpiece. The manual pliers as taught by the invention is particularly suited for applications for which very high requirements with respect to accuracy are demanded, such as for manual pliers with semicircular press jaws for the compression of pipe connections, for example. The manual pliers as taught by the invention can also be formed by manual pliers, in which the press elements have a cutting or a breaking functionality.

In a particularly preferred embodiment of the manual pliers as taught by the invention, this is designed as crimping pliers, with which a workpiece can be compressed that has been formed by an electrical connection element. The crimping pliers as taught by the invention initially contains a first handle and a second handle. The crimping pliers furthermore includes several press elements formed by notching elements for pressing-in multiple notches into the workpiece to be compressed. The press elements have anvil surfaces which are aligned respectively facing one another, between which a holding cross section remains for holding the workpiece to be compressed. A guide is attached to the first handle, in which the press elements are guided radially movable. A drive plate cam is attached to the second handle, which can be rotated opposite the guide. The drive plate cam has notch surfaces that are facing radially inside, which act upon the cam stop surfaces of the press elements that are facing radially outside. By a relative rotation between the guide and the drive plate cam, the press elements are radially displaced to the inside, in order to perform the pressing operation by contraction of the holding cross section.

The drive plate cam can be pivoted relative to the second handle by means of a presetting device formed by an adjusting screw. The manual pliers designed as crimping pliers includes moreover the apparatus for monitoring the wear of the crimping pliers.

Electrical crimping connections are subject to very high requirements in aircraft construction, for example. The opposite pressed-in notches must have a distance which corresponds exactly to the required degree of pressing. The notches must furthermore have the exactly specified form. The press elements of the crimping pliers can consequently be worn only by a small specified degree. From prior art it is known to equip crimping machines with apparatus for monitoring the wear. With the manual pliers as taught by the invention, it is possible for the first time to ensure such monitoring even with portable manual pliers.

Further advantages, details and refinements of the invention can be found in the following description of a preferred embodiment of the manual pliers as taught by the invention, by referring to the drawings, which show:

DETAILED DESCRIPTION OF THE INVENTION

Figure 1:
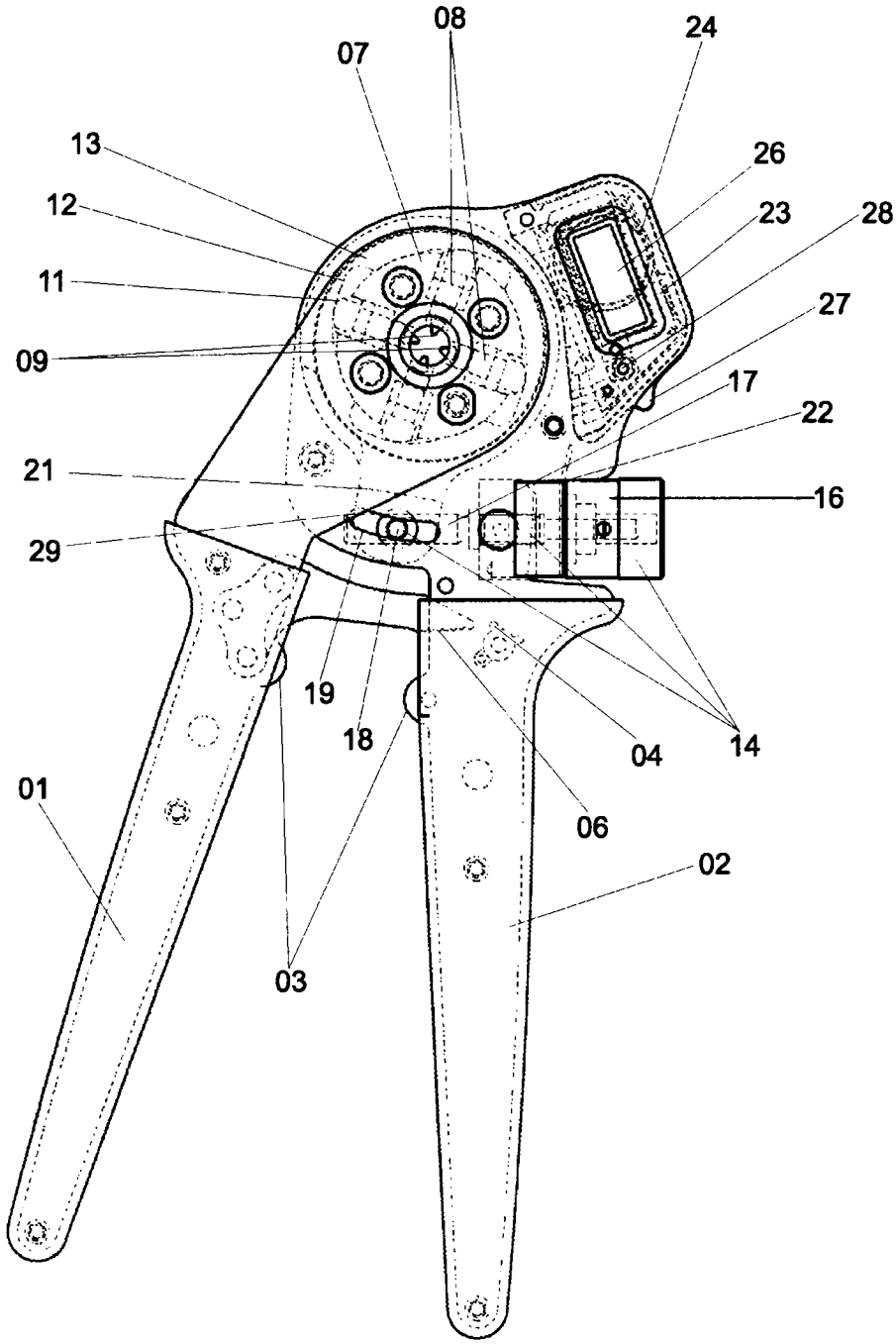
FIG. 1: is a view of a preferred embodiment of the manual pliers as taught by the invention by representation of concealed edges.

FIG. 1 shows a preferred embodiment of the manual pliers as taught by the invention, namely a crimping pliers. In this illustration, concealed body edges are represented by dashed lines. This manual pliers involves a manually actuated crimping pliers from crimping of electrical connections. The crimping pliers includes a first handle 01 and a second handle 02, which are pivotable reciprocally. The crimping cavities of the pliers are opened when both handles 01, 02 are pivoted away from one another. The manual pliers is closed pivoting the two handles 01, 02 towards each other. In this closed state of the crimping pliers, both handles 01, 02 abut each other on limit stops. The manual pliers remains in this closed actuated state, since a rotary latch is engaged in toothing 06. To open the crimping pliers, the rotary latch 04 must be actuated, so that it unlatches from the toothing 06 and releases both handles 01, 02.

A guide 07 is attached to the first handle 01.

The guide 07 essentially has the outer shape of a cylinder, the rotational axis of which forms the first handle 01. Four press elements 08 formed by notch elements are arranged radially movable in the guide 07. The four press elements 08 jointly form a crimp cavity and each have an anvil surface 09, which is provided for pressing-in a notch into the electrical connection element to be compressed. The anvil surfaces 09 of the four press elements 08 are facing each other. During a radial movement of the press elements 08, the anvil surfaces 09 move towards the swivel axis of the handle 01, or away from it. The four press elements 08 have cam stop faces 11 which are facing radially outside, which strike against the cam surfaces 12 of a drive plate cam 13 facing inside.

The drive plate cam 13 has a circular inner cross section, in which the guide 07 is rotatably guided. The drive plate cam 13 is attached to the second handle 02. By actuating the crimping pliers, i.e. by pivoting both handles 01, 02, the drive plate cam 13 and the guide 07 rotate reciprocally. For this purpose, the cam surfaces 12 slide over the cam stop faces 11 of the press elements 08. The cam surfaces 12 are designed such that their distance to the swivel axis changes in the direction of their peripheral expansion. This results in that the press elements which strike with their cam stop faces 11 against the cam surfaces 12 change their distance to the swiveling axis of both handles 01, 02, when the drive plate cam 13 and the guide 07 rotate reciprocally. If the crimping pliers is actuated, then the four press elements 08 are moved in the direction of the swiveling axis. If an electrical connection element is between the anvil surfaces 09 of the press elements 08, then this is compressed, in which context the anvil surfaces 09 of the press elements 08 press notches into the electrical connection element.

The drive plate cam 13 can be pivoted via a presetting device 14 relative to the second handle 02 by an angle of approximately 20°. The presetting device 14 includes a preferably lockable knurled thumb screw 16, which is guided in a thread in the second handle 02. By turning the knurled thumb screw 16, a longitudinal bolt 17 that is fastened on the knurled thumb screw 16 is shifted, in which a transverse bolt 18 is guided. The transverse bolt 18 continues to be guided within a slot link 19, as a result of which the displacement of the transverse bolt is limited.

The transverse bolt 18 is attached on a swivel arm 21 of the drive plate cam 13. A displacement of the transverse bolt 18 via the swivel arm 21 thus produces a partial rotation of the drive plate cam 13 relative to the second handle 02. By turning the knurled thumb screw 16, the drive cam plate 17 can therefore be swiveled relative to the second handle 02. In this way, such part of the cam surfaces 12, which during the complete closure of the manual pliers acts upon the cam stop faces 11 of the press elements 08, is variable. Ultimately, this makes it possible that the distance obtained between the anvil surfaces 09 of the press elements 08, i.e., the degree of pressing obtained, can be selected during the complete closure of the crimping pliers. The adjustment of the degree of pressing with the presetting device 14 serves the purpose of adapting the manual pliers to differently-sized electrical connection elements and additionally also for the purpose for being able to compensate for wear of the manual pliers, particularly wear of the anvil surfaces 09 of the press elements 08.

The position of the presetting device 14, in particular the rotation of the knurled thumb screw 16, can be measured with a rotary encoder 22. The rotary encoder operates incrementally and outputs a defined plurality of impulses per revolution of the knurled thumb screw 16. The rotary encoder 22 is electrically connected with a microcontroller system 23, in which the electrical impulses output by the rotary encoder 22 are processed. The electrical supply for the microcontroller system 23 is by a coin cell 24. The microcontroller system 23 is moreover electrically connected with a digital display 26 on which information can be displayed alphanumerically. To switch on the microcontroller system 23, a first pushbutton 27 must be actuated, for example. A second pushbutton 28 serves for switching between different operating modes of the microcontroller system 23.

In the shown embodiment of the manual pliers as taught by the invention, the distance to be obtained with the presetting device 14 between the anvil surfaces 09 of the pressure elements 08 is between 0.65 mm and 3 mm. With this distance between the anvil surfaces 09 of the press elements 08, this relates to the degree of pressing to be achieved. In this context, the shown manual pliers is provided for degrees of pressing between 0.75 mm and 1.8 mm. One complete revolution of the knurled thumb screw 16 of the presetting device 14 produces a change of 0.2 mm in the degree of pressing to be obtained. The manual pliers as taught by the invention can also be configured for other orders of magnitude of the degree of pressing to be obtained, such as in the sub-millimeter or centimeter range. In particular, the range of the degree of pressing that can be selected by the presetting device, can also have another order of magnitude. The manual pliers as taught by the invention can also be designed such that the presetting device 14 serves exclusively for the compensation of wear.

Following the manufacture of the manual pliers it must be placed in the actuated state prior to the first use. At this time, the coin cell 24 is not yet in the manual pliers, so that the microcontroller system 23 is not yet in operation. Thereafter, the presetting device 14 must be adjusted to its lower limit stop. The lower limit stop is achieved when the transverse bolt 18 has reached its position that is farthest from the knurled thumb screw 16. In this position, the transverse bolt 18 has touched against a limit 29 of the slot link 19, wherein said limit is arranged on the left in the illustration.

This adjusts the smallest degree of pressing of the manual pliers that can be selected with the presetting device 14. In the example shown in the embodiment, this is 0.65 mm. In the next step, the coin cell 24 must be inserted into the manual pliers, whereupon the microcontroller system 23 starts operating. The message "CAL" appears in the display 26, prompting the user to calibrate. A sizing mandrel (not shown) is to be used for calibration, which has a diameter of 2 mm in the embodiment shown. The presetting device 14 must be adjusted by turning the knurled thumb screw 16 to perform the calibration. Since the presetting device 14 is initially still at its lower limit stop, the presetting device 14 can only be adjusted such that the adjusted degree of pressing becomes larger. After the adjusted degree of pressing has approximately reached the size of the sizing mandrel, the user must carefully check whether the sizing mandrel can slide between the anvil surfaces 09 of the press elements 08 without play. Should this not be possible, the degree of pressing must be further enlarged.

Once the sizing mandrel has play when sliding between the anvil surfaces 09 of the press elements 08, then it must be removed again and the degree of pressing must be reduced again, and subsequently it must be checked again whether the sizing mandrel slides between the anvil surfaces 09 of the press elements 08 without play. As soon as a degree of pressing has been adjusted using the presetting device 14, which equals the size of the sizing mandrel, the microcontroller system 23 must be prompted to store the measured value for the position of the presetting device 14. To do so, the second pushbutton 28 must be actuated for a time between 4 seconds and 8 seconds, wherein the first pushbutton 27 must have been activated when the second pushbutton 28 is released. Since the insertion of the coin cell 24, the microcontroller system 23 has counted all impulses of the rotary encoder 22.

The number of these impulses is a measure for the distance of the smallest adjustable degree of pressing at the lower limit stop of the presetting device 14 and for the degree of pressing adjusted with the sizing mandrel. The number of the impulses of the rotary encoder 22 directly represents the measure of the adjustment of the presetting device 14. Because the mathematical connection between the adjustment of the presetting device 14 and the change of the degree of pressing is known, and it is further known that at the time of incorporating the calibrated degree of pressing, the position of the presetting device 14 was equal to the size of the sizing mandrel, the adjusted degrees of pressing can be calculated continuously in the microcontroller system 23. Also, by using the counted impulses of the rotary encoder 22 up to that point, it is possible to make an assumption as to the lowest obtainable degree of pressing that was adjusted at the start of the operation, which can then be stored. This value is filed in a non-volatile memory of the microcontroller system 23 and can be overwritten only by programming at the factory. By incorporating the degree of pressing that was trimmed with the sizing mandrel, the manual pliers has been put into a state ready for operation. The manual pliers can now be adapted to differently sized degrees of pressing by adjustment of the presetting device 14, wherein the currently adjusted degree of pressing is indicated in the display 26.

The display of the adjusted degree of pressing will then show a deviation from the actual adjusted degree of pressing, when the manual pliers, in particular the anvil surfaces 09 of the press elements 08, indicate wear. It will then occur that the actual degree of pressing is larger than the measurement shown in the display 26. For that reason, the calibration procedure must be repeated regularly.

For this, the manual pliers must be closed and the degree of pressing must be adjusted such, using the presetting device 14, that the sizing mandrel slides without play between the anvil surfaces 09 of the press elements 08. If any wear has occurred, then the now selected position of the presetting device 14 will deviate from the position of the presetting device 14 during the preceding calibration procedure. This deviation can be measured by the microcontroller system 23 using a difference of electrical impulses of the rotary encoder 22. Since the interrelationship between the adjustment of the presetting device 14 and the change of the degree of pressing is known, this difference can be converted into a degree of wear of the anvil surfaces 09, using impulses of the rotary encoder 22. If the calculated degree of wear exceeds a pre-adjusted permissible degree of wear, then the microcontroller system 23 indicates an error message "E1" in the display 26. The user of the manual pliers now knows that the anvil surfaces 09 of the press elements 08 are worn to such an extent that the manual pliers must not be used any longer. The pre-adjusted permissible degree of wear in the shown embodiment of the manual pliers as taught by the invention is 0.1 mm, for example. Using the presetting device 14, the user moreover could adjust a degree of pressing to be obtained of exactly 1.5 or 2.0 mm, for example, and calibrate the display of the degree of pressing exactly to that figure. But the user will be prevented from doing so as a result of the error message. In this way it is prevented that the user performs crimping operations in which the anvil surfaces 09 of the press elements 08 are worn more than permissible, such as when the tips of the anvil surfaces 09 are flattened.

Following extended operation of the microcontroller system 23, the coin cell 24 will lose its charge, so that the microcontroller system 23 will no longer operate. The microcontroller system 23 will be operative again after a new coin cell 24 has been inserted.

In this context it must be ensured that the presetting device 14 is located at the lower stop of the limit 29 of the slot link 19 at the time when the new coin cell 24 is inserted. This will ensure that the relative measurement with the incremental rotary encoder 22 continues to be performed from the same reference point. In the event that the presetting device 14 is inadvertently not adjusted at the lower limit stop, then the coin cell 24 must be removed and be inserted again after adjusting the lower limit stop of the presetting device 14.

If the second pushbutton 28 is actuated for a time between 8 seconds and 15 seconds, then several values will be sequentially indicated in the display 26. Initially, the serial number of the manual pliers is displayed. Next, the one degree of pressing will be indicated which was calculated during the first calibration of the manual pliers for the reference position of the presetting device 14. This therefore involves the smallest adjustable degree of pressing which was adjustable with the manual pliers in the non-worn state. The next value to be displayed is the wear value determined during the last calibration performed. The last indication will be the number of calibrations performed since the manufacture of the manual pliers. After each calibration, a counter is incremented in the microcontroller system 23, which represents the number of the previous calibrations performed.

Figure 2:
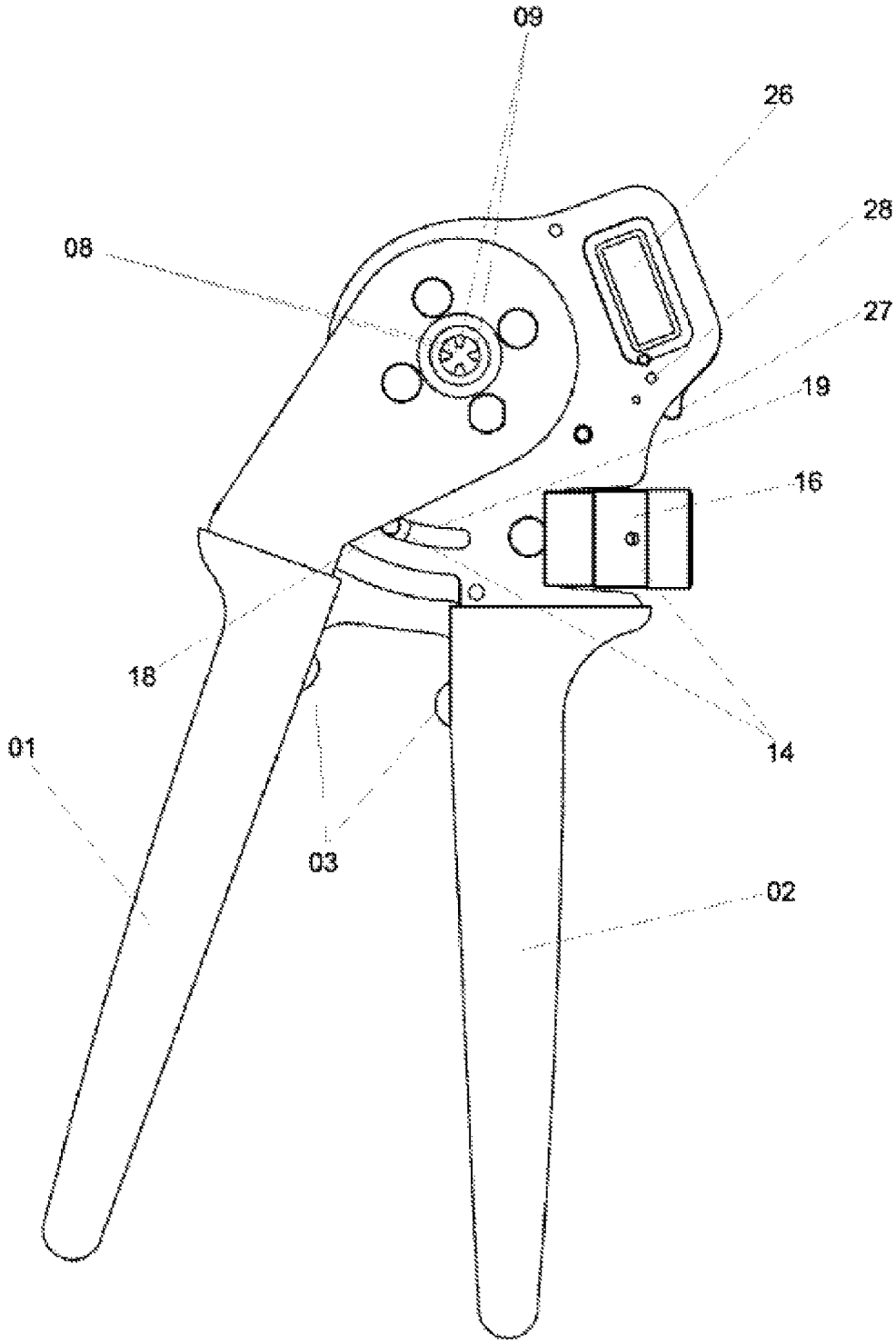
FIG. 2: is a further view of the manual pliers illustrated in FIG. 1, with a presetting device adjusted to a lower limit stop.

FIG. 2 shows a view of the manual pliers shown in FIG. 1, in which the concealed edges are not represented. The presetting device 14, contrary to the state of the manual pliers shown in FIG. 1, is located on its lower stop.

The invention claimed is:

1. A method for monitoring a wear of manual pliers with which press elements can be pressed onto a workpiece and a degree of pressing that can be obtained by actuating the manual pliers is adjustable with a presetting device, comprising the following steps:

detecting a reference position of a presetting device in a non-worn state when press elements in an actuated state of a manual pliers are brought into a position which has a reference degree of pressing by adjusting the presetting device;

detecting a wear position of the presetting device after use of the manual pliers by bringing the press elements in the actuated state of the manual pliers into a position that has the reference degree of pressing, by adjusting the presetting device; and outputing a message if the wear position deviates by more than a permissible degree of wear.

2. A method according to claim 1, wherein the reference position in the non-worn state is detected prior to a first use of the manual pliers following its manufacture or servicing.

3. A method according to claim 1, wherein the detection of the reference position and the detection of the wear position occurs respectively in that a change of a position of the presetting device is measured, while the presetting device, based upon a mechanically defined reference position, is brought into the reference position and/or into the wear position.

4. A method according to claim 3, wherein the mechanically defined reference position of the presetting device is formed by a mechanical stop of the presetting device, in which the press elements have a minimum adjustable degree of pressing.

5. A method according to claim 1, wherein the reference degree of pressing is formed by a size of a calibration standard, which for positioning of the press elements is arranged between them.

6. A method according to claim 1, wherein the position of the presetting device is measured continuously during a normal use of the manual pliers, wherein a measured size is converted continuously to the adjusted degree of pressing, which is indicated.

7. A method according to claim 3, wherein during the detection of the degree of pressing adjusted in the mechanically defined reference position is calculated from the change of the position of the presetting device and is subsequently stored and indicated.

8. A method according to claim 6, wherein the deviation of the wear position from the reference position is converted to a wear that refers to the degree of pressing and is indicated.

9. A method according to claim 6, wherein the conversion of the degree of the position of the presetting device in the respectively adjusted degree of pressing is done depending upon the degree of the wear position last measured.

10. A method according to claim 9, wherein after each detection of the wear position of the presetting device, a calibration counter is incremented.

11. A method according to claim 10, wherein a value of the calibration counter is indicated.

12. Apparatus for monitoring the wear of manual pliers, the press elements of which can be pressed onto a workpiece, where a degree of pressing to be obtained by actuating the manual pliers is adjustable with a presetting device, wherein the apparatus for performing a method comprises:

means for detecting a reference position of a presetting device in a non-worn state when press elements in an actuated state of a manual pliers are brought into a position which has a reference degree of pressing by adjusting the presetting device;

means for detecting a wear position of the presetting device after use of the manual pliers, if when the press elements in the actuated state of the manual pliers are brought into a position that has the reference degree of pressing, by adjusting the presetting device; and means for outputting a message when the wear position deviates by more than a permissible degree of wear.

13. Apparatus according to claim 12, wherein it includes a microcontroller system for processing and storing of measured values as well as a digital display for indicating measured values and messages.

14. Apparatus according to claim 12, wherein it includes an absolute or incremental position sensor for detecting a position of the presetting device.

15. Manual pliers, pressure elements of which can be pressed onto a workpiece and its degree of pressing to be obtained by actuating the manual pliers being adjustable with a presetting device, wherein the manual pliers includes an apparatus, the apparatus including:

means for detecting a reference position of a presetting device in a non-worn state when press elements in an actuated state of a manual pliers are brought into a position which has a reference degree of pressing by adjusting the presetting device;

means for detecting a wear position of the presetting device after use of the manual pliers, when the press elements in the actuated state of the manual pliers are brought into a position that has the reference degree of pressing, by adjusting the presetting device; and means for outputting a message when the wear position deviates by more than a permissible degree of wear.

16. Manual pliers, which is designed as crimping pliers, comprising:

a first and a second handle;

several press elements formed by notching elements for pressing-in multiple notches into a workpiece to be compressed, where the press elements have anvil surfaces that are respectively facing each other, between which a holding cross-section for holding the workpiece remains;

one guide that is attached on the first handle, in which the press elements are guided radially movable;

a drive plate cam with cam surfaces facing radially to an inside which act on cam surfaces of the press elements, and which is attached to the second handle and can be rotated relative to the guide, wherein the press elements are radially displaced to an inside by a relative rotation between the guide and a drive plate cam in order to perform a pressing operation by contraction of a holding cross-section;

a presetting device formed by an adjusting screw by means of which the drive plate cam can be swiveled relative to the second handle; and an apparatus for monitoring the wear of the crimping pliers, the apparatus including:

means for detecting a reference position of a presetting device in a non-worn state when press elements in an actuated state of a manual pliers are brought into a position which has a reference degree of pressing by adjusting the presetting device;

means for detecting a wear position of the presetting device after use of the manual pliers, when the press elements in the actuated state of the manual pliers are brought into a position that has the reference degree of pressing, by adjusting the presetting device; and means for outputting a message when the wear position deviates by more than a permissible degree of wear.

17. Manual pliers according to claim 16, including an absolute or incremental position sensor for detecting a position of the presetting device, wherein the position sensor includes a rotary encoder that is arranged on the presetting device.

* * * * *